United States Patent [19]

Wrobel et al.

[11] Patent Number: 4,856,746

[45] Date of Patent: Aug. 15, 1989

[54] INTERCHANGEABLE SHELF SUPPORT BRACKET

[75] Inventors: Keith A. Wrobel, Rogers; Joel D. Mechelke, Stillwater, both of Minn.

[73] Assignee: LSI Corporation of America, Inc., Minneapolis, Minn.

[21] Appl. No.: 261,682

[22] Filed: Oct. 24, 1988

[51] Int. Cl.[4] ..... A47B 96/00

[52] U.S. Cl. ..... 248/250; 108/107; 248/239

[58] Field of Search ..... 248/250, 235, 239, 244, 248/243, 245, 246, 201; 108/96, 107, 108; 211/90

[56] References Cited

U.S. PATENT DOCUMENTS

| | | | |
|---|---|---|---|
| 3,207,100 | 9/1965 | Peacock | 248/250 X |
| 3,471,111 | 10/1969 | MacDonald | 248/235 |
| 3,471,112 | 10/1969 | MacDonald et al. | 248/239 |
| 3,631,821 | 1/1972 | Zachariou | 248/243 X |
| 3,759,191 | 9/1973 | Freeman | 248/239 |
| 3,870,266 | 3/1975 | MacDonald | 248/235 |
| 4,037,813 | 7/1977 | Loui et al. | 248/250 |
| 4,053,132 | 10/1977 | Del Pozzo | 248/235 |
| 4,285,565 | 5/1983 | Roberts et al. | 248/235 |
| 4,289,289 | 9/1981 | Overman | 248/235 |
| 4,432,523 | 2/1984 | Follows | 248/250 |
| 4,666,117 | 5/1987 | Taft | 248/243 |
| 4,691,887 | 9/1987 | Bessinger | 248/250 |
| 4,735,391 | 4/1988 | Lawrence | 248/239 X |
| 4,736,918 | 4/1988 | Bessinger | 248/250 |

OTHER PUBLICATIONS

Trimline Advertisement, undated.
Stevens Advertisement, undated.
Furniture Design & Manufacturing, 1/88, issue at p. 32.

*Primary Examiner*—Ramon O. Ramirez
*Attorney, Agent, or Firm*—Merchant, Gould, Smith, Edell, Welter & Schmidt

[57] ABSTRACT

An interchangeable shelf support bracket (10) particularly for use with either one of two different thicknesses of shelves includes a side plate (12), mounting pins (14), edge flange (16), and pair of opposing retainer tabs (22, 24) each of which includes a lip (b 26, 28) adapted to receive the edge of one of the two shelves.

14 Claims, 2 Drawing Sheets

INTERCHANGEABLE SHELF SUPPORT BRACKET

TECHNICAL FIELD

The present invention relates generally to a bracket or clip for supporting shelves in cabinets and the like. More particularly, this invention concerns an interchangeable shelf support bracket for securing either one of two different thicknesses of shelves against tipping in a shelf assembly, although it can be used with any thickness shelf.

BACKGROUND ART

Cabinets, bookcases and the like generally include a number of shelves supported between a pair of side walls. The shelves can be supported in either fixed or adjustable positions. Adjustability, of course, is desireable because it allows the user to vary spacing between the shelves in accordance with the height of the items stored thereon. This is typically accomplished with brackets or clips, two of which are generally provided at each end of each shelf, for insertion into holes or sockets in the side walls.

Various types of such shelf support brackets or clips have been available heretofore. In their simplest form, they comprise posts or pins which protrude outwardly from the side wall beneath the edge of the shelf. Such shelf supports provide no locking or retention of the shelves against upward or outward separation from the side walls.

Various forms of shelf supports or brackets having a locking or retention function have also been available heretofore. For example, U.S. Pat. No. 3,759,191 to Freeman shows a reversible cabinet shelf bracket which is rotatable 180° between an up/locked position wherein a vertical pin on the end of a flange is received by a socket in the underside of the shelf, and a down-/unlocked position wherein the pin is out of engagement with the shelf. This bracket retains the shelf against outward movement from the side walls, but not against upward movement or tipping.

Shelf supports with a vertical retention function have also been available heretofore. For example, U.S. Pat. No. 3,870,266 to MacDonald shows a self-locking shelf support comprising an L-shaped bracket with a retractable spring pin at the upper end thereof. U.S. Pat. Nos. 3,471,111 and 3,471,112 to MacDonald show shelf support brackets having resilient fingers which engage the top surface of the shelves. U.S. Pat. Nos. 4,666,117 to Taft; 4,432,523 to Follows; and 4,037,813 to Loui are also representive of the prior art in this regard. While these brackets constrain the shelves against vertical separation, they are only adapted for use with one shelf thickness.

A need has thus arisen for an improved shelf support bracket which can be used with either one of two predetermined thicknesses of shelves, while providing retention against both vertical and outward separation from the side walls.

SUMMARY OF THE INVENTION

The present invention comprises an improved shelf support bracket which overcomes the foregoing and other disadvantages associated with prior art. In accordance with the invention, there is provided a shelf bracket comprising an upright back portion with at least one pin but preferably two pins, extending from one side thereof for receipt in vertically spaced apart openings in a wall of a bookcase, cabinet or the like. A lateral portion extends outwardly from the other side of the back portion for supporting the lower edge of a shelf thereon. The back portion also includes a H-shaped notch with opposing aligned resilient tabs therein, both of which can move out of their normal positions to permit passage of the edge of a shelf. Both tabs include protruding lips on their free ends for constraining either one of two different thicknesses of shelves therein against vertical separation from the bracket. The lateral portion preferably includes a notch for receiving a protrusion on the underside of the shelf in order to constrain the shelf against outward separation therefrom as well.

BRIEF DESCRIPTION OF DRAWINGS

A better understanding of the invention can be had by reference to the following Detailed Description in conjunction with the accompanying Drawings, wherein:

FIG. 4 is a partial sectional view of the shelf bracket herein supporting the edge of a shelf on a side wall in a bookcase, cabinet or the like.

DETAILED DESCRIPTION

Figure 1:
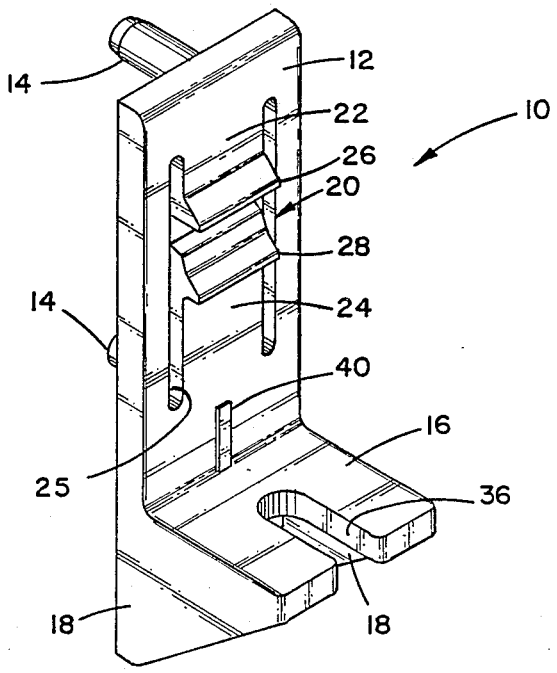
FIG. 1 is a perspective view of the interchangeable shelf support bracket incorporating the invention.
Figure 2:
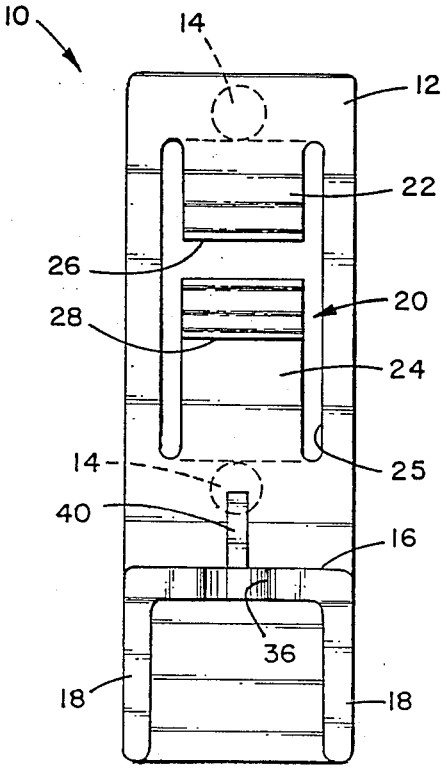
FIG. 2 is a front view of the shelf bracket herein.
Figure 3:
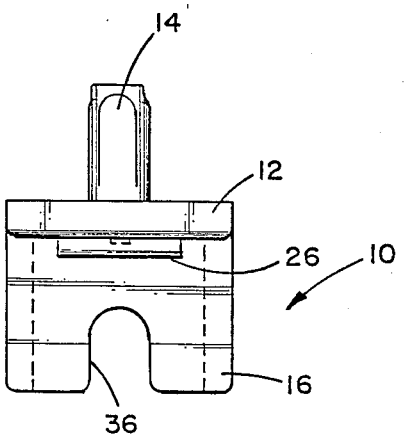
FIG. 3 is a top view of the shelf bracket herein.

Referring now to the Drawings, wherein like reference numerals designate like or corresponding elements throughout the views, there is shown a shelf support bracket 10 incorporating the invention. The bracket 10 can be used in cabinets, bookcases and the like for adjustably supporting the shelves therein. Typically, two such brackets 10 would be used at each end of each shelf. As will be explained more fully hereinafter, the bracket 10 can be used with either one of two different predetermined thicknesses of shelves for supporting the shelf on a side wall and securing it against both vertical and outward movement therefrom.

The bracket 10 includes an upright back or side plate 12. The side plate 12 is preferably rectangular such as about 2.25" by 0.75", although any suitable shape can be used.

A pair of vertically spaced apart lugs or pins 14 are provided on one side of the side plate 12. In accordance with the preferred construction, two such pins 14 are utilized, although only one can be used if desired. As illustrated, the pins 14 are spaced about 1.25" apart, although any suitable spacing can be used. Each pin 14 extends laterally in a direction generally transverse to the side plate 12, and is of generally cylindrical shape. In accordance with the preferred construction, each pin 14 is "roundish" or slightly out of round, such as about 0.193" by 0.178", by about 0.38" long, in order to provide a better fitting tolerance with complementary holes drilled into the side wall (not shown) of a cabinet.

An edge plate or flange 16 is provided on the opposite side of the side plate 12 for supporting the lower edge of a shelf. A pair of gussets 18 are provided between the underside of the edge plate 16 and the adjoining surface of the side plate 12 for reinforcement. As illustrated, two such spaced apart gussets 18 are utilized, although a single gusset can be used instead, if desired.

The bracket 10 also includes a dual thickness shelf retention means 20. The shelf retention means 20 comprises a pair of opposing spring tabs 22 and 24 located within a H-shaped notch 25 in the side plate 12. A lip 26 is provided on the lower, free end of the upper tab 22. Similarly, a lip 28 is provided adjacent the upper free end of the lower tab 24. Each of the lips 26 and 28 includes an inclined upper surface for permitting passage of the end of a shelf thereby, and a flat lower surface for retaining the edge of the shelf thereunder after passage. It will be noted that the tabs 22 and 24 are not as thick as the surrounding portions of the side plate 12, for flexibility and in order to provide clearance for flexing.

Figure 4:
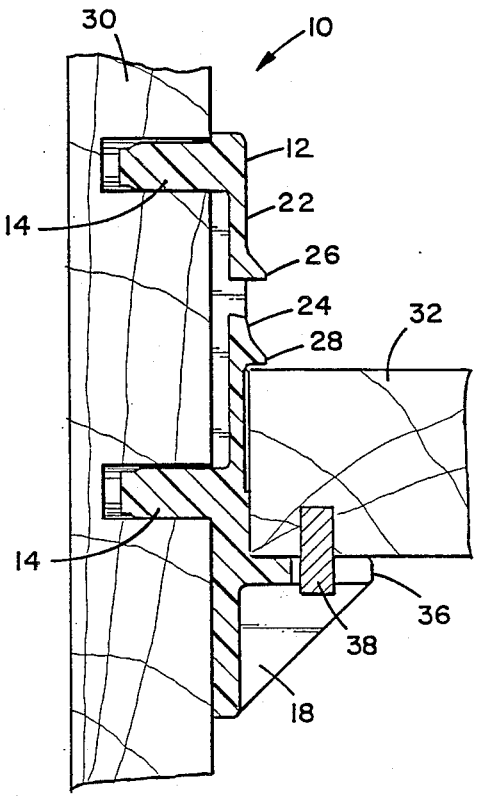
Figure 5:
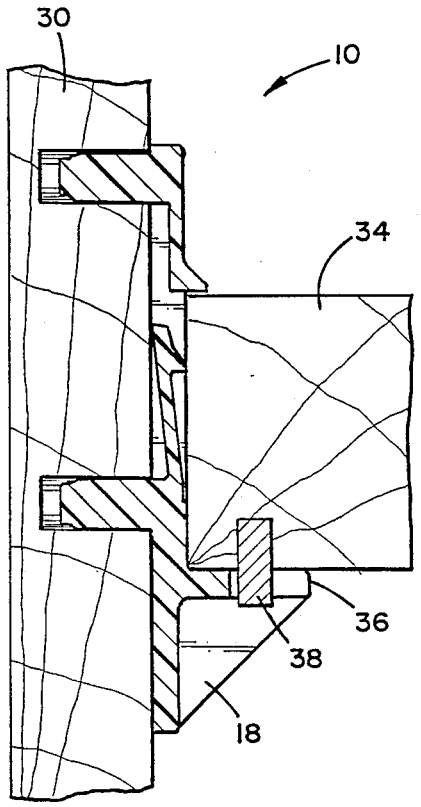
FIG. 5 is a partial sectional view similar to FIG. 4, but showing a relatively thicker shelf supported therein.

FIGS. 4 and 5 show bracket 10 supporting shelves on the side wall 30 of a typical cabinet assembly. As shown in FIG. 4 the lower spring tab 24 serves to retain the edge of a shelf 32 of one predetermined thickness, such as about 0.75 inch, while the upper spring tab 22 serves to retain the edge of a relatively thicker shelf 34, such as about 1.0 inch thick, as shown in FIG. 5.

In accordance with the preferred construction, the edge plate 16 includes a notch 36 therein for receiving a protrusion 38 on the underside of a shelf in order to retain the shelf against outward movement from the side wall. If desired, a raised rib 40 can also be provided on the back plate 12 adjacent flange 16 to avoid sticking between the shelf and bracket 10.

The bracket 10 is preferably of integral molded construction, and can be made from suitable plastic such as reinforced polyester alloy.

From the foregoing, it will thus be apparent that the present invention comprises an improved shelf support bracket having several advantages over the prior art. The primary advantage is that the same bracket can be utilized to support and retain either one of two shelf thicknesses without any modification or adjustment whatsoever. This in turn leads to time and cost savings. Other advantages will be evident to those skilled in the art.

Although particular embodiments of the invention have been illustrated in the accompanying drawing and described in the foregoing Detailed Description, it will be understood that the invention is not limited only to the embodiments disclosed, but is intended to embrace any alternatives, equivalents, and/or modifications or rearrangements of elements falling within the scope of the invention as defined by the following claims.

What is claimed is:

1. An interchangeable shelf support bracket, which comprises:

an upright plate having front and back sides and top and bottom ends;

at least one mounting pin extending from the back side of said plate, said pin being adapted for receipt in a mating hole in a side wall;

a flange extending from the front side of said plate adjacent the bottom end thereof; and retention means including opposing yieldable tabs located in said plate between said flange and the top end of said plate for releaseably engaging the edge of a shelf of either one of two predetermined thicknesses.

2. The interchangeable shelf support bracket of claim 1, wherein said plate is generally rectangular.

3. The interchangeable shelf support bracket of claim 1, wherein two mounting pins are provided in vertically spaced-apart relationship on the back side of said plate.

4. The interchangeable shelf support bracket according to claim 3, wherein each mounting pin is of roundish, slightly rectangular cross section.

5. The interchangeable shelf support bracket of claim 1, wherein said flange includes a central notch therein for receiving a protrusion on the underside of the shelf for retaining the shelf against movement away from the bracket and side wall.

6. The interchangeable shelf support bracket of claim 1, further including:

at least one reinforcing gusset secured between said flange and the bottom end of said plate.

7. The interchangeable shelf support bracket of claim 1, further including:

a raised rib on the front side of said plate adjacent said flange.

8. The interchangeable shelf support bracket of claim 1, wherein said bracket is integrally molded of plastic.

9. An interchangeable shelf support bracket, comprising:

an upright plate having front and back sides and top and bottom ends;

a pair of spaced-apart pins extending from the back side of said plate;

a flange extending from the front side of said plate adjacent the bottom end thereof;

at least one reinforcing gusset secured between said flange and the bottom end of said plate;

opposing upper and lower yieldable tabs located in a H-shaped slot in said plate, said tabs including spaced-apart free ends; and a lip provided on the free end of each of said tabs for releaseably retaining the edge of a shelf of either one of two predetermined thicknesses.

10. An interchangeable shelf support bracket, comprising:

an upright plate having front and back sides and top and bottom ends;

at least one mounting pin extending from the back side of said plate;

a flange extending from the front side of said plate adjacent the bottom end thereof;

opposing upper and lower yieldable tabs located in a H-shaped slot in said plate, said tabs including spaced apart free ends; and a lip provided on the free end of each of said tabs for releaseably retaining the edge of a shelf of either one of two predetermined thicknesses.

11. The interchangeable shelf support bracket of claim 10, wherein two mounting pins are provided in vertically spaced-apart relationship on the back side of said plate.

12. The interchangeable shelf support bracket of claim 10, wherein said flange includes a central notch therein for receiving a protrusion on the underside of the shelf for retaining the shelf against movement away from the bracket and side wall.

13. The interchangeable shelf support bracket of claim 10, wherein said bracket is integrally molded of plastic.

14. An interchangeable shelf support bracket, which comprises:

an upright plate having front and back sides and top and bottom ends;

at least one mounting pin extending from the back side of said plate, said pin being adapted for receipt in a mating hole in a side wall;

a flange extending from the front side of said plate adjacent the bottom end thereof;

means located on said plate between said flange and the top end of said plate for releaseably receiving and retaining the edge of a shelf of either one of two predetermined thicknesses;

said retention means including:

opposing upper and lower yieldable tabs located in a slot in said plate, said tabs including spaced-apart free ends; and a lip provided on the free end of each of said tabs for releasably engaging the edge of one of the shelves thereunder.

* * * * *